US007395785B1

(12) United States Patent
Cross

(10) Patent No.: US 7,395,785 B1
(45) Date of Patent: Jul. 8, 2008

(54) REDUCING HEAT TRANSFER SURFACE AREA REQUIREMENTS OF DIRECT FIRED HEATERS WITHOUT DECREASING RUN LENGTH

(76) Inventor: Alan Cross, 73 - 34 244 th St., Little Neck, NY (US) 11362

( * ) Notice: Subject to any disclaimer, the term of this patent is extended or adjusted under 35 U.S.C. 154(b) by 55 days.

(21) Appl. No.: 11/656,033

(22) Filed: Jan. 22, 2007

(51) Int. Cl.
*F22B 7/04* (2006.01)

(52) U.S. Cl. ..... 122/174; 122/6 R; 122/250 R

(58) Field of Classification Search ..... 122/6 R, 122/174, 235.34, 244, 248, 250 R, 276; 422/198, 422/200; 165/149, 150; 126/360.1, 360.2
See application file for complete search history.

(56) References Cited

U.S. PATENT DOCUMENTS 2,147,609 A * 2/1939 Reed et al. ..... 196/110
2,823,652 A * 2/1958 Mader ..... 122/250 R
3,938,475 A * 2/1976 O'Sullivan et al. ..... 122/333
4,020,772 A * 5/1977 O'Sullivan et al. ..... 122/333
4,034,717 A * 7/1977 Clum et al. ..... 122/359
4,131,084 A * 12/1978 Hanson et al. ..... 122/33
4,194,966 A * 3/1980 Edison et al. ..... 208/132
4,241,869 A * 12/1980 Cratin, Jr. ..... 236/15 BR
4,494,485 A * 1/1985 Kendall et al. ..... 122/250 R
4,522,157 A * 6/1985 O'Sullivan et al. ..... 122/510
4,986,222 A * 1/1991 Pickell et al. ..... 122/6 R
6,241,855 B1 * 6/2001 Gibson et al. ..... 202/124

* cited by examiner

*Primary Examiner*—Gregory A Wilson

(57) ABSTRACT

This invention relates to the design of direct fired heaters which consist of vertically oriented refractory lined enclosures containing tubular heat transfer elements, the elements partially surrounding a cluster of burners. The burners fire gaseous fuel and generate high temperature combustion products which allow for the transfer of heat, by radiation and convection, from the combustion products to the heat transfer elements and the continuous flow of process fluid contained therein. The transferred heat raises the temperature of the fluid from the design temperature at the inlet to the design temperature at the outlet, at a heat transfer rate commensurate with the temperature differential existing at any given location. The surface area requirements of the heat transfer elements and that of the enclosure surrounding the heat transfer elements is significantly reduced by limiting firebox recirculation of burner generated combustion products, thereby increasing overall temperature differentials and heat transfer rates between combustion products and process fluid. Gains in heating surface reduction are not accompanied by losses in heater run length because low process fluid temperatures and high inside heat transfer coefficients are provided, which minimize process fluid film temperature in areas where high heat transfer rates prevail.

2 Claims, 2 Drawing Sheets

END ELEVATION

SIDE ELEVATION

SECTION A-A

REDUCING HEAT TRANSFER SURFACE AREA REQUIREMENTS OF DIRECT FIRED HEATERS WITHOUT DECREASING RUN LENGTH

BACKGROUND OF THE INVENTION

Direct fired heaters find wide application, particularly in oil refineries, where they are used for the purpose of preheating petroleum or petroleum derived feed-stocks for further processing to produce such products as fuel gas, gasoline, diesel fuel, heavy fuel oil and coke. The feed-stocks are of variable composition and boiling range and require that they be preheated to varying temperatures for further processing. Some of the applications considered would be as follows:

Delayed Coking Heater Service, which is one focus of the subject invention, and which involves preheating of high boiling point feed-stocks to high temperature and transferring the heater effluent to a coke drum where it is held for a period of time during which the effluent is converted to a product slate consisting of fuel gas, low boiling point liquids, high boiling point liquids and coke.

Direct fired heaters in this service operate at the most stringent conditions of any in oil refinery service, with the exception of direct fired heaters in thermal cracking service. Thus, the design strategies applicable to heaters in delayed coking service should be applicable to other services as well, including;

Crude Heater Service, wherein pretreated as-received crude is preheated to high temperature prior to being introduced into an atmospheric distillation column where a large spectrum of products with large differences in boiling point are separated from one another, such as gasoline, diesel fuel, heavy fuel oil, and a very high boiling point residuum.

Vacuum Heater Service, wherein residuum from atmospheric distillation is preheated prior to being processed in a distillation tower operated under vacuum, to separate such products as lower boiling point liquids and very high boiling point bottoms liquids from one another.

Visbreaking Heater Service, wherein high boiling point feed-stocks are subject to heat treatment in a fired heater at temperatures lower than those used in a delayed coking heater, resulting in a product slate consisting of fuel gas, gasoline and heavy fuel oil. Reboiling Heater Service, wherein relatively low boiling point feed-stocks are preheated to temperatures at which permit separation of the feedstock constituents in a distillation column is made possible.

Fully Integrated Steam Generating-Steam Superheating-Boiler Feed-Water Service, the direct fired heater for which is the second focus of the subject invention.

The direct fired heaters used for the above services are usually provided with two sections, a radiant section and a convection section. The radiant section consists of a refractory lined enclosure wherein is disposed one or more tubular heating coils thru which the process fluid flows. The heating coils are arranged so as to surround a grouping of one or more burners fueled by gas. The heating coils are arranged so as to form a combustion chamber into which high temperature combustion products generated by the burners are discharged. Heat is transferred from the combustion products to the heating coils, and the process fluid which they contain, principally by radiation.

Process fluid is usually preheated in a convection section prior to entering the radiant section, the convection section consisting of a refractory lined enclosure containing multiple rows of tubes, the rows and the tubes comprising the rows are closely spaced, forming channels thru which combustion products, leaving the radiant section, pass at relatively high velocity. In so doing, heat is transferred from the combustion products to the heating coils and contained process fluid, principally by convection. Ideally, the spent combustion products leave the convection section at low temperature corresponding to a high overall heater thermal efficiency.

Because of the high temperature to which hydrocarbon process fluids in the radiant section are subjected, fluid at the inside wall of the tubular heating elements at this location experience a degree of thermal decomposition, leaving behind adherent coke deposits which reach maximum thickness at the outlet of the coil. These deposits restrict the flow of heat from the tube wall to the contained process fluid so that the tube wall eventually reaches design temperature. At this point, referred to as an end of run condition, the heater must be shut down and de-coked to avoid tube damage. The time interval between shutdowns for decoking is referred to as run length.

SUMMARY OF THE INVENTION

This invention relates to the design of direct fired heaters, in general, and more specifically, to delayed coking heaters and fully integrated heaters for steam generating, steam superheating and boiler feed-water preheating.

The delayed coking heaters consist of a lower radiant section and upper convection section. The convection section consists of a refractory lined enclosure containing a plurality of closely spaced horizontal tubes arranged to form closely spaced planes. Because combustion products passing thru the convection section are relatively low, heat is transferred from the combustion products to the heating coils, and the process fluid flowing through said coils, primarily by convection. Several coils may be contained in the convection section, one of which consists of a process coil, the outlet of which is connected to the radiant section, so that process fluid can be preheated in the convection section, raised to the design temperature required at the inlet of the radiant section, and heated further in said radiant section to design temperatures required at the radiant section outlet, as required for further processing. Additional convection section coils can be added to generate steam, superheat steam, preheat boiler feed-water or for like purposes.

The radiant section is comprised of a refractory lined enclosure having horizontal tubes, arranged in parallel, to form serpentine process heating coils located at each of two parallel and opposed sidewalls of the heater. Rows of closely spaced burners, located at the bottom of the heater, midway between the parallel tube planes and firing vertically upward and with gaseous fuels, provide the heat necessary to raise the process fluid, contained in the heating coils, from design inlet to design outlet temperature. Heat from the high temperature combustion products, generated by the burners, is transferred to the heating coils and process fluid contained therein primarily by radiation. The size and placement of the burners is such as to very substantially limit firebox re-circulation of combustion products. As a result, combustion product temperature at the bottom of the radiant section are very high, much higher than that in heaters of conventional design, and temperatures at the top of the heater are much lower, yet high enough to transfer significant amounts of heat to the process heating coils by radiation.

The arrangement described results overall radiant heat transfer rates that are some 75% higher than heat transfer rates in heaters of conventional design, and accordingly reduce the size and cost of the heater.

Despite the higher radiant heat absorption rates characteristic of heaters designed in accordance with the subject invention, it is nevertheless possible to provide for heater run lengths, as are limited by the deposition of coke on inside surfaces of tubular heating elements, that are essentially equal to those obtained in heaters of conventional design. This is accomplished thru use of heating coil tube sizes consistent with sufficiently high inside heat transfer coefficients to maintain fluid film temperatures in contact with internal high temperature tube surfaces or coke deposits at acceptable levels and, in addition, by locating low temperature radiant coil inlets at the bottom of the radiant section, where combustion product temperature is high, and by locating high temperature radiant coil outlets at the top of the radiant section where combustion product temperature is low.

The fully integrated steam generating, steam superheating, boiler feed water preheating heater follows much the same principals as those used in the design of the delayed coking heater. The radiant section, however, consists of a plurality of vertically oriented parallel tubes dedicated only to the generation of steam, the horizontal tube convection section being dedicated only to the superheating of steam, from saturation temperature at design pressure, to design superheat temperature, to the preheating of boiler feed-water, from design inlet temperature to design outlet temperature, and with a flow-rate in each case being consistent with the design quantity of steam produced.

BRIEF DESCRIPTION OF THE DRAWINGS

One embodiment of the invention, a delayed coking heater, as shown in FIG. 1 and several views thereof, consisting of:

A side elevation as viewed from a vertical plane passing thru the centerline between the two horizontal parallel rows of tubes located at the opposed parallel side walls of the radiant section, the same vertical plane passing thru the horizontal parallel rows of tubes between the two parallel opposed sidewalls of the convection section;

Figures 2, 3:
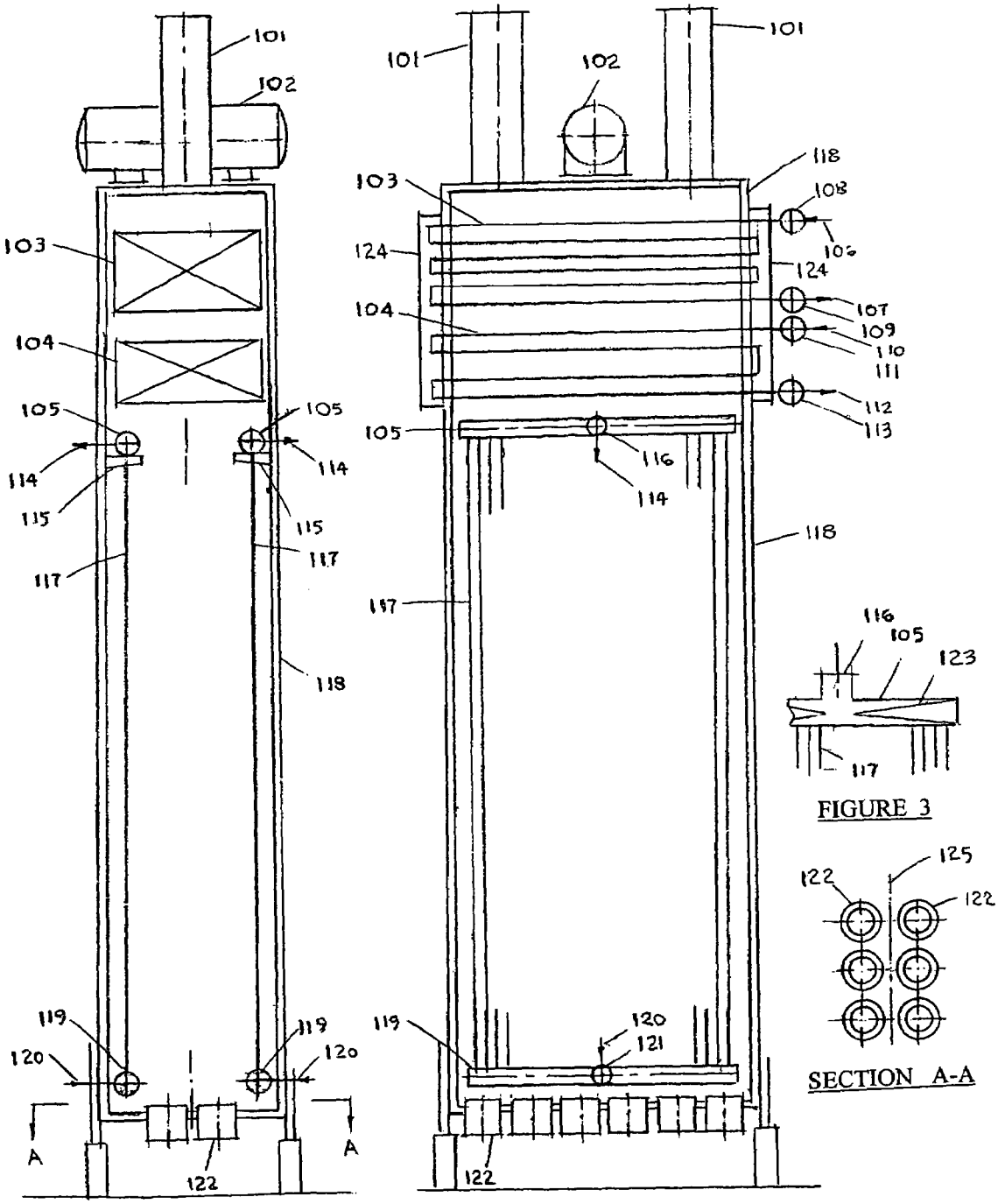

An end elevation as viewed from a vertical plane passing thru the centerline between the two parallel end walls of radiant and convection sections, and perpendicular thereto;

Section A-A as viewed from a plane perpendicular to the centerline between the two rows of burners and passing thru the burners;

Another embodiment of the invention, a fully integrated steam generator, steam super-heater and boiler feed water pre-heater as shown in FIG. 2:

A side elevation as viewed from a vertical plane passing thru the centerline between the two parallel rows of vertical tubes located at the opposed parallel side walls of the radiant section, the same vertical plane passing thru the horizontal parallel rows of tubes between the two opposed parallel sidewalls of the convection section;

And FIG. 3, a section as viewed from a plane perpendicular to the longitudinal axes of the horizontal upper radiant section outlet manifold, passing thru the manifold and showing the arrangement of internal conical inserts at either end of the manifold, such that the two phase flow regime of steam and water thru the manifold is homogeneous throughout the length of the manifold.

DETAILED DESCRIPTION OF THE INVENTION

Figure 1:
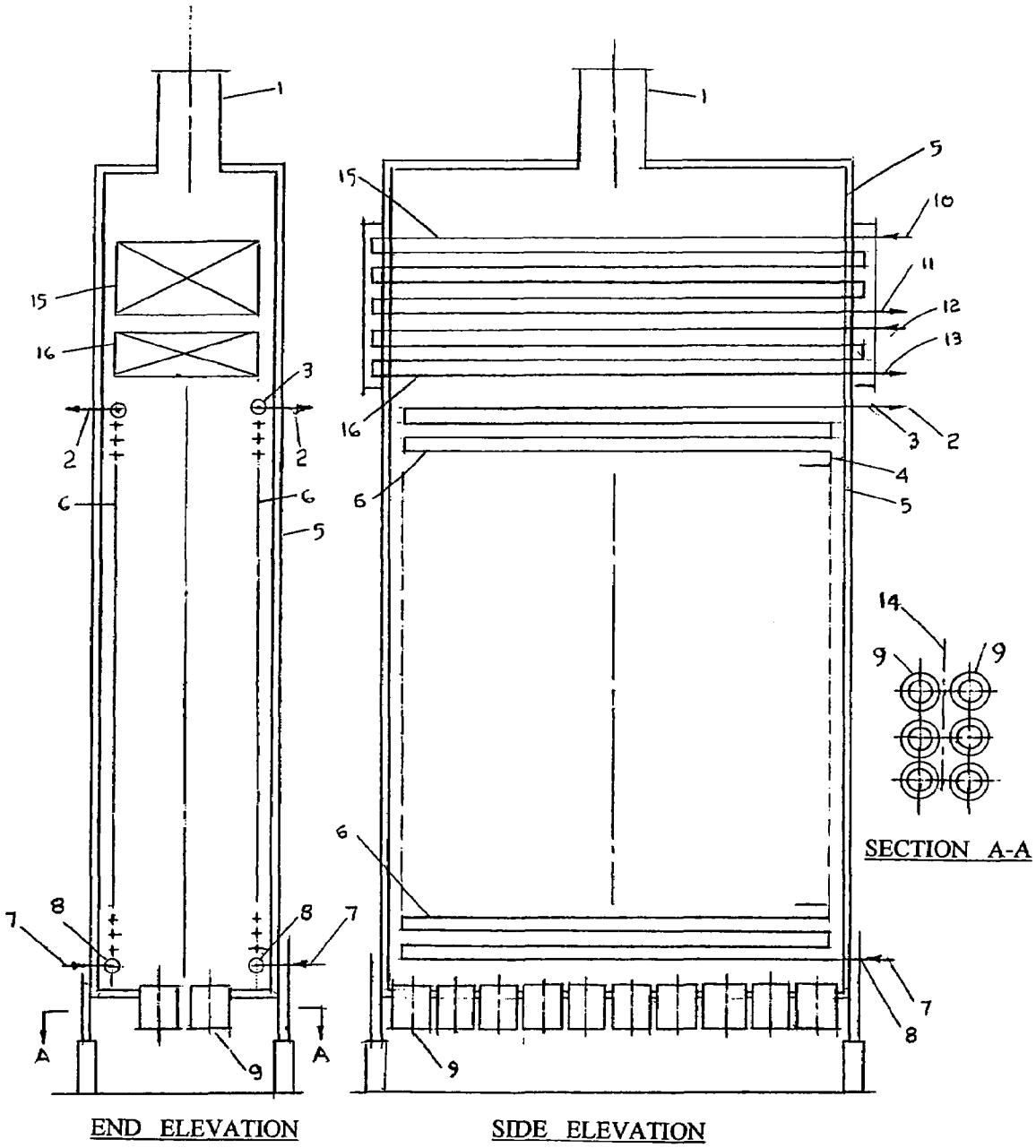

One embodiment of the invention, a delayed coking heater, as shown in FIG. 1, consisting of component parts as follows:

1. A stack allowing for products of combustion leaving the convection section to be discharged to the atmosphere.
2. Radiant section process heating coil outlet.
3. Radiant section process heating coil outlet tubes.
4. 180 degree return bends connecting adjacent horizontal tubes of radiant section process heating coils.
5. Refractory lined walls of radiant section enclosure.
6. Horizontal tubes of radiant section process heating coil.
7. Radiant section process heating coil inlet connection.
8. Radiant section process heating coil inlet tubes.
9. Two rows of burners firing gaseous fuels.
10. Horizontal tube auxiliary convection section heating coil inlet connection.
11. Horizontal tube auxiliary convection section heating coil outlet connection.
12. Horizontal tube process convection section pre-heat coil inlet connection.
13. Horizontal tube process convection section pre-heat coil outlet connection connected by conduit to radiant section process heating coil inlet connection.
14. Centerline between adjacent rows of burners at bottom of radiant section enclosure coinciding with centerline between parallel opposed side walls of radiant section.
15. Auxiliary coil convection section.
16. Process preheat coil convection section.

Heaters configured using design parameters proposed by this invention differ in a number of ways from heaters configured using design parameters in current usage, this being evident by comparing configuration data for a delayed coking heater designed in accordance with current practice with a heater designed in accordance with the subject invention, the heaters in each case being vertically oriented with horizontal serpentine coils located at either sidewall and with burners located midway between heating coils and firing upwards from the bottom of the heater. The two heaters being compared although having different configurational differences, do have operating conditions in common, these being as follows:

| | |
|---|---|
| Process fluid inlet and outlet temperature: | 600 and 920 F. respectively. |
| Process heat absorption: | 100 million BTU per hour. |
| Inside tube heat transfer coefficient: | 400 BTU/hour-square foot-degree F. |
| Fuel fired: | Gas. |
| Burners type: | Air-fuel premix before combustion. |
| Process fluid - combustion product flow arrangement: | Cocurrent |

The following are configurational and performance data for a delayed coking heater designed in accordance with conventional practice which differ from that for the same heater designed in accordance with the subject invention.

| | Conventional Design | Design as Proposed by Invention |
|---|---|---|
| Number of burners: | 44 | 28 |
| Number of burner rows: | 1 | 2 |
| Distance between heating coils | 8.0 feet | 8.0 feet |
| Burner inside diameter: | 1.33 feet | 1.0 feet |
| Net free area around burners: | 1000 square feet | 314 square feet |
| Combustion products, lbs/hr, divided by net free area around burners, sq. ft. | 168 | 478 |

-continued

| | Conventional Design | Design as Proposed by Invention |
|---|---|---|
| Heater dimensions, Width/Length/Height, feet | 8.0/66/21 | 8.0/42/40 |
| Number of radiant cells | 2 | 1 |
| Height to width ratio: | 2.5 | 5.0 |
| Combustion product temperature, Top/Bottom, degrees F.: | 1800/1850 | 1600/2200 |
| Overall average radiant heat flux, BTU/hour-square foot: | 10000 | 17700 |
| Relative run length: | 1.0 | 1.1 |

The above data demonstrate several important advantages obtainable thru use of heaters designed in accordance with the subject invention, these being;

A 44% reduction in heating surface requirements;

A corresponding decrease in the size of the refractory lined heating surface enclosure.

A run length essentially equal to that of a heater of conventional design;

A heater that occupies 80% less plot area

These data also indicate the fundamental differences between the two heaters resulting thru use of the design concepts made available by the subject invention, a key concept being the reduction in radiant section cross-sectional flow area perpendicular to the flow of combustion products generated by the burners. This strategy decreases re-circulation of combustion products, increases combustion product temperature at the bottom of the heater, close to the burners, increases heat transfer rates by radiation and convection, from combustion products to radiant section process heating coils, reduces process heating coil surface requirements and the overall size of the heater. That these effects are in fact obtainable is validated by examination of the performance of conventionally designed heaters. Thus, the commonly used assumption and experimental observation is the near equality of top and bottom combustion product temperature in a bottom fired vertical heater. It can be reasoned that this is due to the use of relatively small burners firing into a very large combustion chamber, so as to provide space sufficient to allow for a large amounts of combustion product re-circulation and top to bottom mixing. Use of a simplified re-recirculation model using as a basis the effect of the combustion chamber size relative to burner size has demonstrated that the aforementioned reasoning is very nearly correct and can be used to calculate re-circulation rates for heater configurations that are markedly different from those in a conventionally designed heater as in the case of the subject invention.

Despite the higher heat transfer rates characteristics of heaters designed in accordance with the subject invention, it is nevertheless possible to maintain run lengths for such heaters at low levels, comparable to those obtainable in heaters of conventional design. This is accomplished by providing; co-current flow for combustion products and process fluid; by maintaining process fluid film temperatures at low levels, thru use of low process fluid inlet temperatures of 600 F or less, and by providing for inside tube heat transfer coefficients of not less than 400 BTU per hour per square foot per degree F.

A second embodiment of the invention, a fully integrated steam generator, steam super-heater, and boiler feed water pre-heater, as shown in FIG. 2, and consisting of component parts as follows:

101. Two stacks allowing products of combustion leaving the convection section to be discharged to atmosphere.

102. A steam drum.

103. Boiler feed water pre-heat coil convection section.

104. Steam superheat coil convection section.

105. Upper radiant section steam generating coil outlet manifold, encased in refractory.

106. Convection section boiler feed water preheat coil inlet connection.

107. Convection section boiler feed water pre-heat coil outlet connection, connected by conduit to steam drum

108. Convection section boiler feed water pre-heat coil inlet manifold.

109. Convection section boiler feed water preheat coil outlet manifold.

110. Convection section steam superheat coil inlet connection, connected by conduit to steam drum.

111. Convection section steam superheat coil inlet manifold.

112. Convection section steam superheat coil outlet connection.

113. Convection section steam superheat coil outlet manifold.

114. Radiant section steam generating coil upper manifold outlet connection connected by conduit to steam drum.

115. Radiant section steam generating coil supports.

116. Radiant section steam generating coil upper manifold outlet nozzle.

117. Radiant section steam generating coils consisting of a plurality of vertical parallel tubes.

118. Refractory lined radiant section enclosure.

119. Radiant section steam generating coil lower inlet manifold, encased in refractory.

120. Radiant section steam generating coil lower inlet manifold, connected by conduit to steam drum.

121. Radiant section steam generating coil lower manifold inlet nozzle.

122. Two rows of burners firing gaseous fuel.

123. Internal conical inserts at each end of upper steam generating coil outlet manifolds.

124. Enclosures at each end of convection section tubes to prevent air infiltration.

125. Centerline between adjacent rows of burners at bottom of radiant section enclosure coinciding with centerline between parallel opposed sidewalls of radiant section.

Configurational and performance data for a fully integrated direct fired steam generator, steam superheater, and boiler feed water pre-heater, of a design in accordance with the subject invention, are summarized as follows:

| | |
|---|---|
| Total heat absorption, million BTU per hour: | 100 |
| Burner outside/inside diameter, inches: | 33/25 |
| Number of burners: | 10 |
| Number of burner rows: | 2 |
| Clearance between outside burner diameters, inches: | 6 |
| Clearance between burner outside diameter and centerline of heating coil, inches: | 15 |
| Net free area around burners, square feet: | 82 |
| Combustion products, lb./hr. divided by net free area around burners, sq./ft. | 1510 |

-continued

| | |
|---|---|
| Heater width/length/height, feet: | 8.0/15.2/39.5 |
| Height to width ratio: | 5.0 |
| Overall average heat transfer rate, BTU per hour per square foot: | 26500 |
| Flow arrangement: | co-current |

Performance data which differ for heaters of conventional design and heaters of a design in accordance with the subject invention, are as follows:

| | Conventional Design | Design as Proposed by Invention |
|---|---|---|
| Combustion product bottom/top temperature, degrees F.: | 2300/2300 | 2650/1583 |
| Steam generating coil radiant section heat absorption, million BTU per hour: | 25.9 | 52.5 |
| Steam generating coil convection section heat absorption, million BTU per hour: | 26.6 | 0 |
| Steam superheat coil convection section heat absorption, million BTU per hour: | 25.4 | 25.4 |
| Boiler feed water coil convection section heat absorption, million BTU per hour: | 22.3 | 22.3 |
| Total heat absorption, million BTU per hour: | 100 | 100 |

If heaters of conventional design were to operate at the same overall average heat transfer rates as heaters designed in accordance with the subject invention, the latter heaters would have a distinct advantage, as can be noted from the above performance data. Thus, for equal transfer rates, the heater of conventional design requires that a sizeable fraction of the total steam generation absorption be shifted to the horizontal tube convection section. This is most undesirable because natural circulation steam generation would then be impossible, because of the resulting high overall pressure drop for both the radiant and convection section coil combination. Additionally, a satisfactory homogeneous flow regime in the horizontal tube convection section would be difficult to acquire, unless use of a high velocity, high pressure drop arrangement, requiring forced circulating pump usage were resorted to. In contrast, the design in accordance with the subject invention confines steam generation to the vertical tube radiant section so that all the advantages of a natural circulation system are achieved.

The invention claimed is:

1. A direct fired delayed coking heater consisting of a radiant and convection section comprising;

a convection section located above the radiant section and consisting of a plurality of tubes on triangular or square centers contained in a refractory lined enclosure having a quadrilateral cross-section;

a centerline to centerline spacing of tubes in said enclosure measured horizontally or vertically and equal to two or more outside tube diameters;

a plurality of interconnected horizontal tube planes comprised of said tubes and oriented perpendicularly to the flow of combustion products leaving the radiant section;

a grouping of interconnected horizontal convection section tube planes surfaced so as to preheat incoming process fluid to a design temperature of about 600 F at design throughput;

a grouping of horizontal interconnecting convection section tube planes providing heat transfer surface sufficient for recovering additional heat from and lowering the temperature of combustion products leaving the radiant section;

a radiant section consisting of a vertical refractory lined enclosure of quadrilateral cross-section oriented perpendicularly to the flow of combustion products;

two serpentine process heating coils in said radiant section consisting of a plurality of interconnecting horizontal tubes with longitudinal axes of adjacent tubes horizontally oriented forming planes parallel to and located at each of opposing parallel sidewalls of the heater enclosure;

a spacing of adjacent tube axes in said parallel sidewall planes equal to two or three outside tube diameters measured adjacently and a spacing of tube axes in said parallel sidewall planes equal to 1.5 outside tube diameters measured from the inside face of the refractory lining of the radiant section enclosure walls;

a radiant section process coil inside tube diameter consistent with an inside heat transfer coefficient not less than 400 BTU per hour per square foot per degree F. as measured at the radiant coil inlet and outlet;

a radiant section process coil arrangement locating coil inlets at the bottom of the radiant section at a point closest to the burners and coil outlets at the top of the radiant section at a point farthest from the burners;

a radiant section process heating coil inlet temperature of 600 F and a radiant section process coil surfaced to provide an outlet temperature of approximately 920 F at design throughput;

a radiant section having a width equal to 8.0 feet as measured by the centerline to centerline distance between tube planes located at the parallel opposing sidewalls of the radiant section enclosure and perpendicular thereto;

a radiant section length equal to the distance between the inside parallel refractory faces of the enclosure end walls and perpendicular thereto;

a gross area of the plane perpendicular to the flow of combustion products equal to the product of said length and width;

a net cross-sectional area of said perpendicular plane equal to the gross cross-sectional area minus the total inside area of the burners located at the bottom of the radiant section enclosure and equal also to the total flow of combustion products in pounds per hour divided by an empirically determined constant equal to not more than 1510;

a radiant section burner grouping of gaseous fueled burners firing vertically upward from the bottom of the radiant section enclosure;

an inside diameter of the burners forming said grouping equal to not more than 25;

a clearance between the outside diameters of adjacent burners equal to 6 inches;

a burner arrangement consisting of two identical parallel rows and a centerline between adjacent rows coinciding with the centerline between the opposed parallel side walls of the radiant section enclosure.

2. A direct fired fully integrated steam generator, steam super-heater, and boiler feed water pre-heater comprising:

a steam generator located wholly in the radiant section and a steam super-heater and boiler feed water pre-heater located wholly in the convection section;

a convection section consisting of a plurality of tubes on triangular or square centers contained in a refractory lined enclosure having a quadrilateral cross-section;

a centerline to centerline spacing of tubes in said enclosure measured horizontally or vertically equal to two or more outside tube diameters;

a plurality of interconnected horizontal tube planes formed of said tubes and oriented perpendicularly to the flow of combustion products leaving the radiant section;

a radiant section consisting of a vertical refractory lined enclosure of quadrilateral cross-section oriented perpendicularly to the flow of combustion products;

steam generating coils in said radiant section having a plurality of parallel tubes surfaced so as to provide a design flow rate of steam at the prevailing saturation temperature;

longitudinal axes of said tubes vertically oriented forming planes parallel to and located at each of the parallel opposing side walls of the radiant section enclosure;

a spacing of tube axes of said parallel sidewall planes equal to two to three outside tube diameters measured adjacently and a spacing of tube axes in said parallel sidewall planes equal to 1.5 outside tube diameters measured from the inside face of the refractories lining the radiant section enclosure walls;

an inside radiant section tube diameter consistent with an inside heat transfer coefficient not less than 1000 BTU per hour per square foot per degree F. as measured at the radiant coil inlet and outlet;

an arrangement of radiant section tubes wherein the ends of said tubes terminate in relatively large diameter horizontally oriented collection manifolds encased in refractory and located at the top and bottom of the radiant section;

a radiant section manifold arrangement wherein each manifold is provided with a single connection located at the midpoint of the manifold;

the top outlet manifold provided with conical inserts located at either side of the manifold outlet connection and such that the large ends, of the inserts are located at a point in the manifold farthest from the outlet connection and the small ends of the inserts are located closest to the outlet connection;

a downward flow of liquid water from a steam drum located at the top of the convection section enclosure passing thru a conduit connected to the inlet of the lower manifold and flowing upward thru the radiant section coils;

a partially vaporized flow of water exiting the radiant section coils and entering the upper manifold where discharge of the steam-water mixture occurs thru the upper manifold outlet connection;

an upward flow of the steam-water mixture thru a conduit connecting the upper manifold outlet connection to the steam drum resulting in subsequent separation of the steam and water from the two phase mixture in said steam drum;

a flow of steam exiting the steam drum and flowing downward thru a conduit connecting the steam drum to the inlet of the convection section steam superheat coil;

the steam superheat coil surfaced to provide a heat absorption corresponding to the design inlet and outlet temperature of the coil at design flow rate;

a flow of treated boiler feed water entering a convection section boiler feed water preheat coil located above the steam superheat coil and surfaced to provide a heat absorption corresponding to the design inlet and outlet temperature of the coil at design flow rate;

the exiting boiler feed water flowing upward thru a conduit connected to the steam drum providing make up for the boiler feed water converted to steam;

a radiant section having a width of 8.0 feet as measured from by the centerline to centerline distance between the tube planes located at the parallel opposing side walls of the radiant section enclosure and perpendicular thereto;

a radiant section length equal to the distance between the inside parallel refractory faces of the enclosure end walls and perpendicular thereto;

a gross area of the plane perpendicular to the flow of combustion products equal to the product of said length and width;

a net cross-sectional area of said perpendicular plane equal to the gross cross-sectional area minus the total inside area of the burners located at the bottom of the radiant section enclosure and equal also to the total flow of combustion products in pounds per hour divided by an empirically determined constant equal to not more than 1500;

a radiant section burner grouping of gaseous fueled burners firing vertically upward from the bottom of the radiant section enclosure;

an inside diameter of the burners forming said grouping equal to not more than 25 inches;

a clearance between the outside diameters of said burners equal to 6 inches;

a burner arrangement consisting of two identical parallel rows and a centerline between adjacent rows coinciding with the centerline between the opposed parallel side walls of the radiant section enclosure.

* * * * *